United States Patent [19]

Simpson et al.

[11] Patent Number: 4,516,679

[45] Date of Patent: May 14, 1985

[54] TAMPER-PROOF WRAP

[76] Inventors: Carolyn N. Simpson, 1946 E. 6400 South, Salt Lake City, Utah 84121; John A. Perry, 1838 Wasatch Dr., Salt Lake City, Utah 84104

[21] Appl. No.: 439,303

[22] Filed: Nov. 4, 1982

[51] Int. Cl.[3] ..... B65D 73/00

[52] U.S. Cl. ..... 206/459; 206/807; 428/321.5; 428/916; 215/365

[58] Field of Search ..... 206/459, 807; 428/321.5, 916; 215/365, 230, 250

[56] References Cited

U.S. PATENT DOCUMENTS

| | | | |
|---|---|---|---|
| 3,809,217 | 5/1974 | Harrison | 206/807 |
| 3,933,304 | 1/1976 | Judd | 206/807 |
| 3,952,869 | 4/1976 | Sansom | 206/459 |
| 4,098,577 | 7/1978 | Halpern | 206/807 |
| 4,423,819 | 1/1984 | Cummings | 206/807 |

*Primary Examiner*—Joseph Man-Fu Moy

*Attorney, Agent, or Firm*—Mallinckrodt, Mallinckrodt, Russell & Osburn

[57] ABSTRACT

A multipli-layered tamper-proof wrap consisting of a number of over-layed thin plastic sheets bonded around the outer edge to contain one or a number of chemical layers therein, appropriately separated, whose penetration or puncture will result in a visual indication at the puncture, and including distinct seals fixed at spaced intervals to the outer or external wrap sheet that indicate wrap or product origin and are to discourage wrap substitution. The wrap is for encapsulating a consumer product so as to provide a continuous wrap surface therearound that will give a visual indication of a breach in wrap integrity at a point of penetration or puncture.

27 Claims, 7 Drawing Figures

TAMPER-PROOF WRAP

BACKGROUND OF THE INVENTION

1. Field

The invention relates to wraps for encasing or enveloping a product for shelf display in a retail store where a change in wrap color and/or integrity could denote a product tampering.

2. Prior Art

In recent times, the country has experienced great shock and concern over the apparent intentional mischief of someone substituting strychnine poison for the capsule contents of a well-known over-the-counter pain relief drug. This tampering and the subsequent deaths has drastically pointed up the need for a product packaging whose integrity the purchaser can verify that will give an indication if tampering has occured. Where, heretofore, packaging efforts have generally been directed toward tamper-proof lids and bottle seals, none, within the knowledge of the inventors, have been directed toward an effective tamper-proof wrap. In the past, product encapsulating wraps have generally concentrated on maintaining product freshness or as barriers to atmosphere. The present invention, additional to providing such a barrier, provides also a visual indication of a tampering by a wrap discoloration, physical change, or deterioration to alert the purchaser that the product within that wrap may have been tampered with.

SUMMARY OF THE INVENTION

It is, therefore, a general object of the present invention to provide a wrap for use in encasing a consumer product for shelf display where a tampering with the wrap to effect entry therethrough would cause a wrap discoloration, physical change, or deterioration at the point of entry.

It is another object of the present invention to provide a wrap that would discolor or otherwise provide a visual indication at or around a puncture therethrough, even if such puncture is as small as that would be made by a hypodermic needle.

It is another object of the present invention to provide a wrap that can be easily constructed in multi-layers to be folded over itself, encasing a product or the like, such that wrap edges are separated from the wrap interior by wrap portions that will discolor, provide a physical change, or otherwise deteriorate upon penetration or puncture.

It is still another object of the present invention to provide a multi-layer wrap that includes chemical layers separated by a barrier whose puncture and the subsequent chemical mixing causes a color change, wrap deterioration, or release of gas or heat, or alternatively involves a single chemical layer whose release will result subsequent chemical mixing causes a color change, wrap deterioration, or release of gas or heat, or alternatively involves a single chemical layer whose release will result in a color change, a reaction with the plastic exterior sheet, or will "weep" at the point of puncture.

It is still another object of the present invention to provide a multi-layer wrap that includes an outer layer whereon is embossed a distinctive seal at spaced intervals thereover, which seal can identify the product or wrap and is provided for discouraging someone's removal of the tamperproof wrap and substitution of another wrap, providing another visual indication of product integrity.

In accordance with the above objects, the present invention in a tamper-proof multi-layer wrap includes individual layers of thin film or sheets, preferably plastic, that may be transparent, translucent, or colored that are layed over one another and bonded together around a common edge to form a single, multi-layer wrap. Between the layers is arranged one or a number of compounds or chemicals spread or applied uniformly thereover, or impregnated in a mat or mat-like material. The multiple layers are separated from one another and are such that should the compounds or chemicals come together, a reaction will take place therebetween that will result in a color change, a generation of a gas or heat, or the like, and, optionally, a single layer of a moisture absorbing indicator or a chemical that is reactive with air, or the moisture in the air, or a bladder containing a single chemical to react or "weep" through an outer plastic sheet on puncture, or the like, can be so used. Additionally, the outer or exterior wrap sheet preferably includes stamps or seals fixed thereto at spaced intervals. The seals can denote wrap or product origin, can include product lot number, or the like, and are provided to discourage a wrap substitution. The seals preferably are of sufficient complexity to minimize the possibility of counterfeiting.

The individual sheets or layers are sealed or bonded around an edge, forming a single sheet that is sufficiently flexible for use in wrapping a product, which wrapping should be such that the sealed edges can be bonded together or rolled with one another and bonded by an adhesive bonding or the like, to the wrap's outer surface. So arranged, a wrap edge will be opposite to a wrap surface that is chemically active or the bonding will be such as to leave chemically active spaces at the bond to preclude a person tampering with the product's interior by going through a wrap edge. Thereby, there will exist a chemically active wrap section or sections at all points surrounding a product encased therein. This product can then be placed in a conventional box or can be displayed alone. Further, optionally the invention can include applying distinctive scals at intervals along the wrap edge that is bonded to the wrap surface, further minimizing the likelihood of tampering with the wrap at that junction.

BRIEF DESCRIPTION OF THE DRAWING

In the drawings that illustrate that which is presently regarded as the best mode for carrying out the invention.

DETAILED DESCRIPTION

Figure 1:
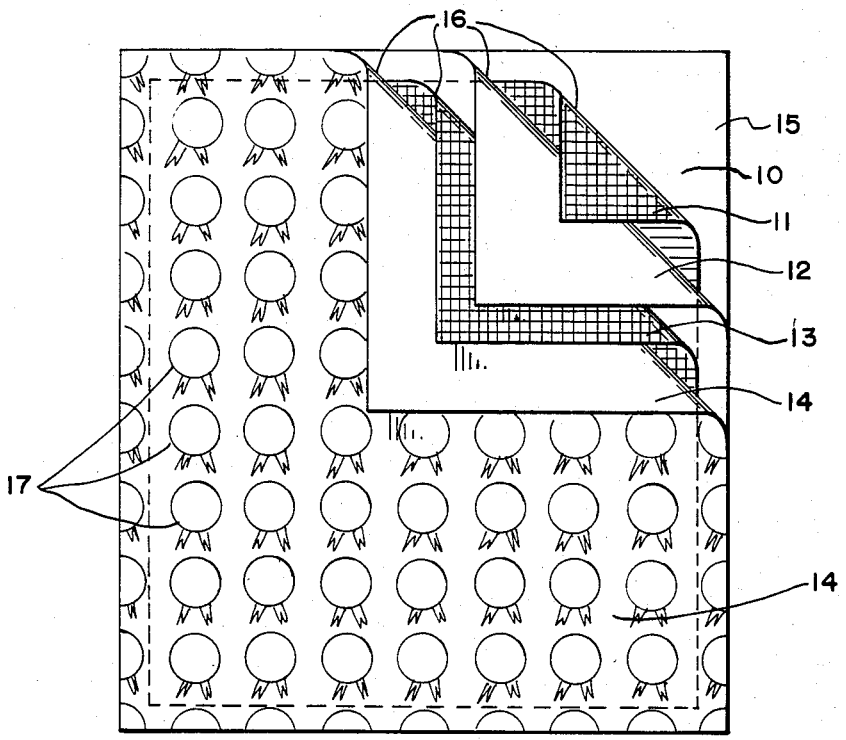
FIG. 1 is a top plan view of a first embodiment of the present invention, showing the wrap as including five layers, the top four of which layers are shown folded back on one another across a corner.

Referring now to the drawings:

In FIG. 1 is shown a first embodiment of a tamper-proof wrap of the present invention that includes five layers or sheets, 10, 11, 12, 13, and 14, that are stacked one on top of the other and are sealed or bonded together at edge 15. Edge bonding of the layers can be by application of an adhesive bonding, by application of heat and pressure thereto, or by any like method and can be accomplished in a vacuum. Shown in FIG. 1, the layers are folded back from folds 16 and are leafed apart to illustrate, that except at edge 15, they are independent from one another. The exterior or outer sheet 14, as shown in FIGS. 1, 2, and 3, preferably includes a number of distinctive seals 17, or like impressions made by stamp, and are embossed, printed, fixed by heat application, or the like, at spaced intervals thereover.

Figure 2:
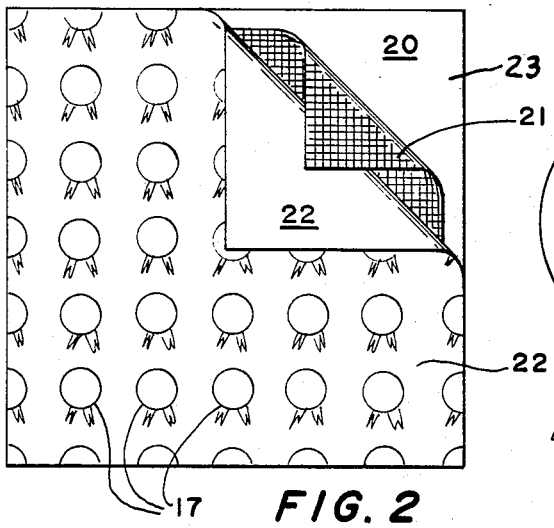
FIG. 2 is a top plan view of another embodiment of a tamper-proof wrap showing it as including three layers, the top two layers shown folded back on one another across a corner.
Figure 3:
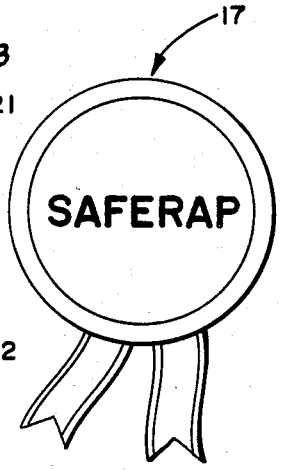
FIG. 3 is a section of a top outer wrap layer showing an enlargement of one of the distinctive seals that are fixed at spaced intervals over the entire exterior wrap surface.

FIG. 2 shows another wrap embodiment as consisting of three layer or sheets. In this embodiment, a first inner or bottom sheet 20 contacts the consumer product, the middle layer is shown as a mat, or the like that is impregnated with or is a coating of a chemical, and an exterior or top sheet 22 that includes distinctive seals 17 thereover. This wrap is essentially like the wrap of FIG. 1 and is sealed or bonded around the edge, which bonding can be accomplished in a vacuum, but involves only a single layer of a compound or chemical. Such chemical is such that upon exposure to atmosphere, it will absorb water from the atmosphere and change color, or will chemically react with the air or moisture therein to cause a generation of a gas or heat to cause a wrap deterioration, swelling, or the like, indicating a tampering with that wrap at that point of exposure to atmosphere. This mat or like layer as described with respect to layers 11 and 13 of the wrap of FIG. 1 and can also be in a chemical coating of the inner face or faces of the exterior or bottom sheets. The wraps of FIGS. 1 and 2 are applied to the product so as to encapsulate it and both of which wraps includes sealed or bonded edges 15 and 23, respectively, that during such wrapping will be maintained separated from the wrapped product by an open wrap surface that will change color, discolor, decompose, or ooze therefrom, when penetrated, as described hereinbelow.

Chemical impregnated layers 11 and 13 in the embodiment of FIG. 1 upon mixing as by cutting or piercing the center sheet 12, will come together and react to produce a color change as say from clear to yellow, red to blue, blue to pink or red, or the like, that is dependent upon the chemicals selected, or will create heat, or will release a gas, or the like to swell, decompose or discolor the wrap, at that point of mixing. For example, with one of the layers 11 or 13, a select acid-base indicator such as Paranitroplenol in a liquid form, and the other layer a basic compound, should penetration occur through the separation sheet 12, at that point where the compounds of layers 11 and 13 are brought together, a color change from clear or colorless to yellow will result. This change is set out in the reaction;

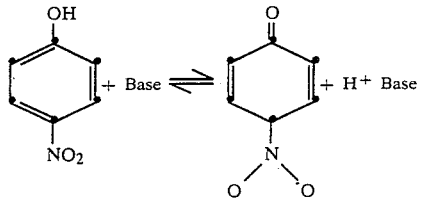

$NO_2CCHCHCOHCHCH$ $NO_2CHCHCHCOCHCH$
Colorless Yellow and includes a change in the Ph range of 5.0 to 7.0.

Or, by impregnating one of the layers 11 or 13 with another acid base indicator such as Phenlphthalein in a liquid form and the other layer with a base, the colorless liquid will change to red on mixing as by cutting through separation sheet 12 This change is set out in the reaction;

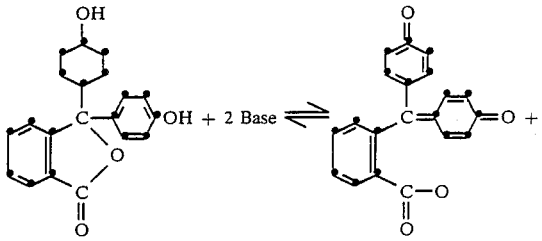

Phenolphthalein Colorless Red

2 H+ Base and includes a change in the Ph range of 8.0 to 9.6

A similar acid-base reaction is provided using a methyl orange in liquid form as one layer and a base for the other, a mixing resulting in a change in color from pink or red to yellow, by the reaction;

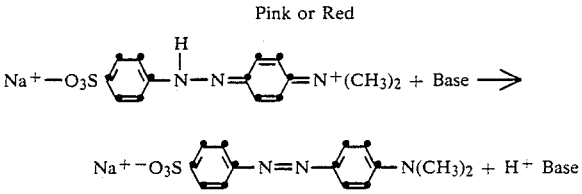

Yellow including a pH change at 3.1 to 4.4

The above detail only several acid-base indicators where a hydrogen ion exchange occurs, changing pH, resulting in a coloration or change in color of the solutions. Obviously, therefore, other acid-base indicators could be so used within the scope of this disclosure.

Additional to the acid-base reactions, a practice of the present invention can include arranging other chemicals as one of the as layers 11 or 13 separated by sheet 12 that, when mixed with the other layer a chemical reactant will provide a change in color, or will produce as a product of that reaction heat or a gas such as to cause a rapid deterioration of the wrap at the point of mixing. As for example, a moisture absorbing indicator such as cobalt chloride, $CoCl_2$, when exposed to water will change from blue to pink or red. Therefore, by providing a fine grind of cobalt chloride, $CoCl_2$, as one of the layers 11 or 13, with water arranged as the other layer, their mixing will result in a readily apparent color change. Cobalt chloride, $CoCl_2$, or like a moisture absorbing indicator can also be used with the embodimentment of FIG. 2 as will be explained later herein.

Any similar arrangement of a chemical compound that will react with water could be so used. For example, mixing calcium carbonate, $CaC_2$, with water, produces an alkyne commonly known as acetylene gas, which gas would expand or rupture the wrap, indicating a wrap tampering. Of course, other chemicals will react to produce gas alkynes, and could be similarly used with, as necessary, a substitution of an appropriate reagent for the water. Additionally, to produce a wrap deterioration or mixing of the contents of the layers of 11 and 13, a chemical reactive with water to give off heat, could be so used. For example, phosphorous or a select phosphorous compound in a dry state can be arranged as one layer with water as the other. Whereby, on mixing, the chemical will react with the water to generate heat providing a wrap deterioration at that point of mixing. Obviously, only slight amounts of phosphorous or a phosphorous compound can be so used to avoid ignition of the wrap. Other appropriate chemicals to generate heat on mixing with the liquid could be so used provided also that the quantities used are such as will not cause a spontaneous combustion or give off toxic fumes, or create a like hazard on mixing. It should, therefore, be understood that the present invention is not limited to any particular chemical or chemicals and that other chemicals appropriate for the uses as described could be substituted within the scope of this disclosure, providing such chemicals and the quantity selected would produce an acceptable wrap deterioration only and would not create a hazard of fire or noxious or toxic gas.

Hereinabove a wrap involving two chemical layers separated by a sheet has been discussed. In FIG. 2, another embodiment is shown that includes a single center layer 21 that is sandwiched between bottom and exterior or top sheets 20 and 22. As with the earlier described chemical layers 11 and 13, the chemical for layer 21 is preferably one selected to provide a discoloration or generation of heat or gas on contact with air, or will ooze from the wrap or will provide a wrap deterioration at a point of puncture that would be apparent even with a slight puncture or penetration, as with a hyperdermic needle. Further, where a deterioration of the wrap itself is provided, the chemical reaction should be such that the wrap will deteriorate but will not, in that deterioration process, create harmful or dangerous gases or result in a spontaneous combustion. A powder of a moisture absorbing indicator such as the above discussed cobalt chloride, $CoCl_2$, could be so used, changing color from blue to pink or red on the adsorption of water from the air. Also, a chemical in a dry state such as phosphorous or an appropriate phosphorous compound that would combine with moisture in the air to create heat on exposure to air could be so used. In a practice of the present invention, therefore, any chemical or chemical compound that would have a reaction with air or the moisture in air could be so used within the scope of this disclosure, and, optionally, a chemical or compound such as an ink or dye in an oil, water, or like fluid, could be arranged as layer 21 to ooze from a break or puncture in one of sheets 20 or 22, providing a visual indication of a wrap penetration.

Layer 21 could also be arranged as a bladder containing a checmical that will react with the material selected to construct the exterior or bottom sheet 22 or 20, to provide a deterioration thereat. For example, a bladder of polyethylene containing a dilute solution of Petrahydrofuran, $OCH_2CH_2CH_2CH_2$, will cause a deterioration of certain types of polyvinyl chloride PVC plastic and so could be so used in this arrangement.

Figure 4:
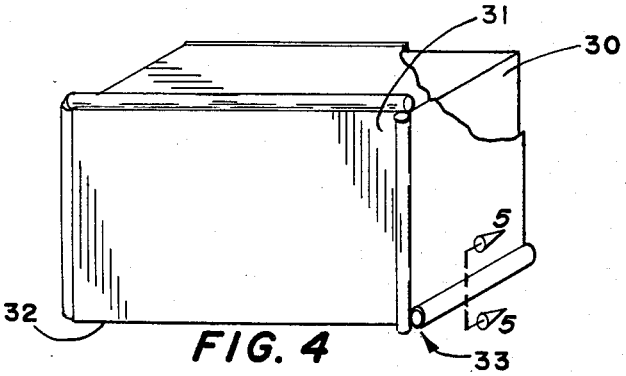
FIG. 4 shows an upstanding product sitting on a base section of wrap showing a second section of wrap draped thereover the meeting edges of the first and second wrap on one side shown rolled together, that roll shown fixed to the second section of wrap surface.
Figure 5:
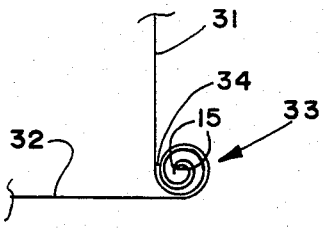
FIG. 5 shows a removed portion of the rolled edges of FIG. 4 expanded and showing an adhesive layer between the rolled section and the side of the second wrap surface section.

In FIG. 4, an article of manufacture, such as a drug product 30 shown in broken lines as a box, is draped with a first section 31 of tamper-proof wrap and is positioned on top of a second or base sheet 32 of like tamper-proof wrap. Wraps 31 and 32 can be the wraps described with respect to FIG. 1 or 2, and preferably include arranged over the outer surface thereof, distinctive seals 17, that are shown also in FIG. 3. Shown best FIG. 5, the respective wrap edges 15 are rolled together at 33, a layer of adhesive 34 is fixed along a rolled surface, and a surface of that rolled edge is then pressed into contact with the surface of draping wrap 31. So arranged, the respective edges 15 are themselves enclosed within a chemically active portion of the wraps 31 and 32 such that a puncture through that rolled portion would penetrate a chemically active section of a wrap and would result in either discolor or deterioration thereat, as described above. Of course, a penetration anywhere on wraps 31 or 32, excepting the edges, would result in that chemical discoloration as described.

While adhesive bonding shown hereinabove is preferred for maintaining the rolled wrap section edges to a wrap surface, other bonding arrangements such as use of heat, or the like, could be used, providing that such would not disrupt the wrap layer integrity so as to cause a discoloration thereat or so as to render the chemicals thereat ineffective. Also, while not shown herein, it should be obvious that a product could be wrapped in a single sheet and the edges appropriately folded back upon one another and bonded to chemically active sections of that wrap within the scope of this disclosure. Or, alternatively, only one or more than two sections of wrap could be so arranged, the wrap edges rolled together, the wrap fully surrounding or encapsulating a product with the scope of this disclosure.

Figure 7:
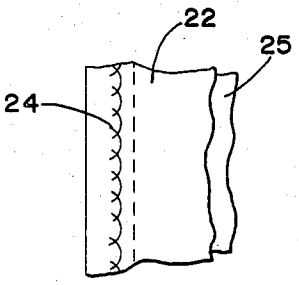
FIG. 7 is a top plan view of the wrap and product of FIG. 6, showing the bond pattern as overlapping half circles.
Figure 6:
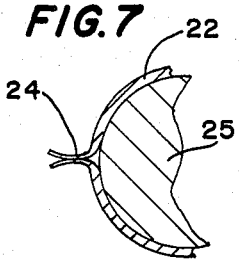
FIG. 6 is a partial cross-sectional view of a product tightly encapsulated in a section of wrap drawn tightly therearound and bonded along meeting edges.

Shown in FIG. 6, is a product 25, that has a round shape and is wrapped tightly in a single sheet of wrap. The wrap meeting edges are, in turn, sealed together, as shown in FIG. 7, by application of a clamping seal thereto and preferably includes an application of heat at the seal face junctions to cause a flowing together of the plastic sheets. To avoid a destruction of the wrap activity at such sealed edge, the contacting portions of the seal faces are preferably patterned, illustrated as a "weave" over "over-lapping half circles" shown at 24 in FIG. 7, whereby active wrap areas will remain between the sealed or bonded portions that will discolor, as described above, on penetration.

While the invention shown and described herein has been directed to wraps of three or five sheets or layers, it should be obvious that any number of multiple sheets or layers could be so used, including a bladder as a single layer containing a chemical or chemical compound, within the scope of this disclosure, and the sheets could be of any plastic material appropriate for the purposes detailed herein. While a mat or mat-like material is shown in FIGS. 1 and 2 as layers 11, 13, and 21, respectively, it should be understood that such could be any appropriate sheet of plastic material, a bladder, or even a coating or coatings on the separator sheet 12 or the bottom and exterior or top sheets, respectively. Also, the wrap layers 11, 13, and 21 could be such as to be transparent or nearly transparent, and could also be less than transparent or translucent, or even opaque, as needed to hold a chemical therein to function as described. The layers and sheets called for herein have intentionally not be identified by any weight or product name, and it should be understood that there are numerous plastic sheets, films, and the like, and mat materials that would be suitable for a practice of the present invention as described hereinabove.

Of the several embodiments of a preferred tamper-proof wrap of the present invention which have been shown and described herein, it should be understood the present disclosure is made by way of example only and that other arrangements of the tamper-proof wraps additional to those shown herein and their use and arrangement for wrapping a consumer product therewith are possible without departing from the subject matter coming within the scope of the following claims, which claims we regard as our invention.

We claim:

1. A tamper-proof wrap for encasing a consumer product for shelf display comprising, interior and exterior sheets of a thin plastic material positoned over one another and bonded together around the outer edge and including a layer of a select chemical sealed therebetween such that on puncture of a wrap exterior sheet, a chemical response will occur that will produce a visual indication at the wrap puncture; and distinctive seal means fixed at spaced intervals over said wrap exterior sheet.

2. A tamper-proof wrap as recited in claim 1, wherein the wrap includes two outer sheets, one in contact with the consumer product and the other the exterior sheet with a middle layer of a chemical whose exposure will produce a visual change in the wrap character at the point of penetration.

3. A tamper-proof wrap as recited in claim 2, wherein the chemical is a moisture absorbing indicator which will absorb water to change color.

4. A tamper-proof wrap as recited in claim 2, wherein the chemical is one that is reactive with water to give off heat.

5. A tamper-proof wrap as recited in claim 2, wherein the chemical is a dye.

6. A tamper-proof wrap as recited in claim 2, wherein the inner layer is a bladder containing a chemical selected to react with one of the thin plastic sheets on puncture of the bladder.

7. A tamper-proof wrap as recited in claim 2, wherein the inner layer is a chemical impregnated mat.

8. A tamper-proof wrap as recited in claim 2, wherein the inner layer is a layer of the select chemical coated over the inner surface of one of the thin plastic sheets.

9. A tamper-proof wrap as recited in claim 1, wherein the thin plastic sheets are transparent.

10. A tamper-proof wrap as recited in claim 1, wherein the sheets of thin plastic material sandwiching a layer of a compound therebetween are bonded around the outer edge and distinctive seals are applied at intervals to that bond.

11. A tamper-proof wrap as recited in claim 1, wherein the sheets of thin plastic material sandwiching a layer of a compound therebetween are bonded together around the outer edge in a vacuum.

12. A tamper-proof wrap for encasing a consumer product for shelf display comprising, inner and exterior sheets of a thin plastic material positioned over one another and at least one separator sheet of a thin plastic material sandwiched theretween separating different layers of compounds from one another, the sheets bonded together around the outer edge, and the compounds selected to provide a reaction on their mixing at a puncture of the separator sheet to provide a visual indication at that puncture; and distinctive seal means fixed at spaced intervals over said wrap exterior sheet.

13. A tamper-proof wrap as recited in claim 12, wherein one of the layers is in a fluid state, one of the layers is a layer of a chemical selected to produce a color change on mixing with a reagent, and the layer of a compound separated therefrom by the separator sheet is a reagent.

14. A tamper-proof wrap as recited in claim 13 wherein the selected chemical is one that will produce an acid-base reaction and the selected reagent is a base.

15. A tamper-proof wrap as recited in claim 13, wherein the selected chemical is a moisture absorbing indicator and the reagent is water.

16. A tamper-proof wrap as recited in claim 12, wherein one layer is in a fluid state, one of the layers is a layer of a chemical selected to release a gas on mixing with a reagent, and the layer of a compound separated therefrom by the separator sheet is a reagent.

17. A tamper-proof wrap as recited in claim 12, wherein one of the layers is in a fluid state, one of the layers is a layer of a chemical selected to release heat on mixing with a reagent, and the layer of a compound separated therefrom is a reagent.

18. A tamper-proof wrap as recited in claim 12, wherein the layers are mats impregnated with the compounds.

19. A tamper-proof wrap as recited in claim 12, wherein one of the layers is a selected chemical, coated over a separator sheet surface.

20. A tamper-proof wrap as recited in claim 12, wherein one of the layers is a layer of a thin grind of a selected chemical maintained over one face of the separator sheet and a layer separated therefrom by said separator sheet is a liquid maintained over said other separator sheet face.

21. A tamper-proof wrap as recited in claim 12, wherein the sheets of thin plastic material sandwiching the separator sheet and layers of compounds therebetween are bonded around the outer edge and distinctive seals are applied at intervals to that bond.

22. A tamper-proof wrap as recited in claim 12, wherein the sheets of thin plastic material sandwiching the separator sheet and layers of compounds therebetween are bonded together around the outer edge in a vacuum.

23. A method for encasing a consumer product for shelf display in a tamper-proof wrap that will provide a visual indication of a puncture comprising the steps of positioning a consumer product on a section of the wrap large enough to completely encase the product; wrapping the product with that wrap such that the wrap edge meet and overlay one another; rolling the wrap edges together; and bonding the rolled wrap edges to a section of the wrap surface that will provide a visual indication of a puncture.

24. A method as recited in claim 23, wherein the rolled wrap edges are bonded to the wrap surface by application of a layer of an adhesive therebetween and pressing the respective surfaces together.

25. A method as recited in claim 23, wherein the rolled wrap edges are bonded to the wrap surface by application of heat thereto sufficient to cause a fusion of the plastic surfaces together.

26. A method as recited in claim 23, further including the step of fixing distinctive seals at spaced intervals along the junction of the bond of the rolled wrap edges to the wrap surface.

27. A method as recited in claim 23, wherein a plurality of sections of wrap are used to wrap the consumer product and the edges of the sections of wrap are rolled together for bonding to the wrap surface.

* * * * *